United States Patent [19]

Weddendorf

[11] 4,114,541

[45] Sep. 19, 1978

[54] ROTATING CAFETERIA TYPE FOOD SERVICE COUNTER WITH IMPROVED DRIVE SYSTEM

[75] Inventor: Elmer R. Weddendorf, Cincinnati, Ohio

[73] Assignee: B/W Metals Company, Inc., Fairfield, Ohio

[21] Appl. No.: 809,288

[22] Filed: Jun. 23, 1977

[51] Int. Cl.[2] ..... B01D 33/00

[52] U.S. Cl. ..... 108/20; 211/1.5; 248/349

[58] Field of Search ..... 108/20, 94, 95, 96, 108/103, 104, 105, 21, 22; 211/1.5, 151; 248/415, 425, 349

[56] References Cited

U.S. PATENT DOCUMENTS

| | | | |
|---|---|---|---|
| 1,090,552 | 3/1914 | MacDonald | 108/21 |
| 1,400,948 | 12/1921 | Florence | 108/20 X |
| 1,468,247 | 9/1923 | Patten | 248/349 X |
| 1,726,990 | 9/1929 | Kramer | 108/20 |
| 2,633,970 | 4/1953 | Robinson | 108/20 X |
| 3,039,615 | 6/1962 | Uihlein et al. | 211/1.5 |

*Primary Examiner*—Roy D. Frazier
*Assistant Examiner*—Peter A. Aschenbrenner
*Attorney, Agent, or Firm*—Wood, Herron & Evans

[57] ABSTRACT

A rotating cafeteria type food service counter that includes a generally circular counter top supported on top an immobile framework by idler rollers mounted to the framework. The drive shaft includes upper and lower sections, the upper section being fixed to the underside of the counter top in axial fashion, and the lower section being carried in bearings mounted on the counter's framework. A drive motor assembly is connected with the drive shaft's lower section. A universal joint connects the drive shaft's upper and lower sections. The use of the universal joint permits the counter top to tilt or flex slightly relative to its rotational axis if required to maintain supportive contact with the idler rollers for minimizing vibration of the counter top during rotation.

3 Claims, 3 Drawing Figures

ROTATING CAFETERIA TYPE FOOD SERVICE COUNTER WITH IMPROVED DRIVE SYSTEM

This invention relates to food service counters. More particularly, this invention relates to a food service counter of the rotating cafeteria type.

Over the years the cafeteria style of serving food has been one of the mainstays of the food service industry. This style of distributing food to the consumer has been found particularly effective in connection with institutional type feeding such as commonly is found in schools, hospitals, and the like. The cafeteria style food service facility is also quite popular with large corporations in connection with the feeding of employees at lunchtime. Of course, the cafeteria style food distribution system also has been used over many years in retail restaurant installations. All such food service facilities are commonly known as cafeterias.

Historically, the food service counters in cafeteria style food service operations have been of extended length and of a flat, table-like configuration. Prepared food of each individual food dish is placed on the counter in dish columns extending from the front edge to the rear edge of the extended length counter, the dishes of food in each column being the same, e.g., the same salad or same dessert or the like. The customer's tray is supported on a tray support rail that is fixed to the counter along the front edge thereof, and extends outwardly therefrom. In use, a customer walks from one end of the food service counter to the other, making periodic selections of different food dishes along the way. Thus, as the customer moves from one end of the counter to the other he pushes the tray on the tray support rail in front of him, periodically makes food selections from the counter top, and places those selections on his tray.

In recent years, there has been developed a new type cafeteria counter that is of a circular outer periphery. The circular counter top rotates about a center axis at a relatively slow rate. The counter top rotates between a kitchen or food supply area and a customer service area, the kitchen and customer service areas usually being separated one from the other by a wall or other suitable divider. The counter's supply of dished food is selected and removed from the counter top by customers standing along the counter's periphery within the customer service area, and that food supply is replenished on the counter top by employees within the kitchen area.

The rotating cafeteria type food service counter is becoming popular particularly with institutional and in-plant type facilities. The rotating style food service counter does not require the customer to walk the length of the counter available for customer service. On the contrary, the customer stands completely still while the food dishes move past the customer in sight and within easy reach. In other words, the customers stand still as the food counter top (with dished food thereon) rotates past for selection or rejection by the customer. It has been found that the method of serving food by a rotating food service counter provides fast service, requires less customer service area, reduces mechanical installation costs, and provides an efficient use of labor, relative to the historical cafeteria style food service counter in which the customer walked from one end of the counter to the other.

Historically, one of the earliest drive systems known for rotating cafeteria type food service counters is that illustrated in Kinkaid Pat. No. 2,968,363. As shown in that patent, the rotating counter top is supported centrally thereof by a rigid center shaft that is driven by a motor and belt. Idler rollers are provided above and below the counter surface at the periphery thereof to stabilize and sustain the rotating counter top in a horizontal attitude.

In practice, the drive system illustrated in this patent resulted in vibration in the counter top particularly over an extended period of use as the rigid center shaft bearings would wear. This vibration of the counter top would cause dished foods thereon to 'walk' on the counter top surface, and also would cause undesirable noise in the retail atmosphere of a cafeteria. Further development of rotating cafeteria type food service counters dictated the necessity of a drive system which was relatively maintenance free, and which rotated the counter top in a vibration free manner. Such a system is illustrated in Weddendorf Pat. No. 3,872,801. As shown in that patent, the counter top is carried on a plurality of vertical idler rollers adjacent the inner and outer edges of the counter top, and is maintained in centered relation on the counter's framework by a plurality of horizontal idler rollers disposed around the outer peripheral edge of the counter top. A plurality of separate friction wheel drive assemblies is also provided, the motor driven friction wheels engaging the underside of the counter top for rotating the counter top relative to the framework. This drive system is particularly suitable for use with rotating counters having a large outer diameter, e.g., eighteen feet or twenty-three feet. The drive system illustrated in this latter patent is a successful drive system that has seen significant commercial use. However, the drive system shown in this patent does require multiple drive assemblies, i.e., multiple drive motors, which makes it a relatively expensive drive system.

It has been an objective of this invention to provide a rotating cafeteria type food service counter having a drive system that utilizes a single drive motor and a single drive shaft fixed coaxially to the counter top, yet which permits the counter top to tilt or flex slightly relative to its rotational axis if required to maintain supportive contact with the idler rollers for minimizing vibration of the counter top during rotation.

It has been another objective of this invention to provide a rotating cafeteria type food service counter having a drive system that uses a flexible drive shaft, the drive shaft being fixed axially at one end to the counter top and drivingly connected at the other end with a single drive motor, the counter being supported solely by idler rollers on which the counter top rests thereby permitting the counter top to flex or tilt slightly relative to its rotational axis for minimizing vibration in the counter during rotation of the counter top.

In accord with these objectives, the rotating cafeteria type food service counter of this invention includes a generally circular counter top supported on top an immobile framework by idler rollers mounted to the framework. The drive shaft includes upper and lower sections, the upper section being fixed to the underside of the counter top in axial fashion, and the lower section being carried in bearings mounted on the counter's framework. A drive motor assembly is connected with the drive shaft's lower section. A universal joint connects the drive shaft's upper and lower sections. The use of the universal joint permits the counter top to tilt or flex slightly relative to its rotational axis if required to maintain supportive contact with the idler rollers for minimizing vibration of the counter top during rotation. Preferably, the lower section is simply received in bearings that maintain its axial alignment and does not offer any vertical support to the counter top centrally thereof.

Other objectives and advantages of this invention will be more apparent from the following detailed description taken in conjunction with the drawings in which.

Figure 1:
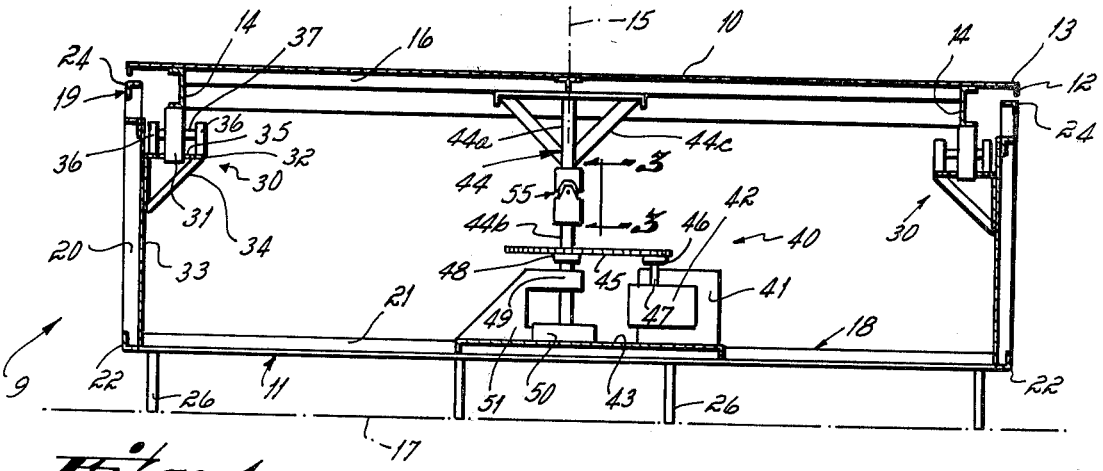
FIG. 1 is a side cross-sectional view illustrating a food service counter in accord with the principles of this invention.

The improved rotating cafeteria type food service counter 9 of this invention is illustrated generally in FIG. 1. As shown in that figure, the counter 9 includes a circular counter top 10 that is horizontally disposed for rotation on framework 11. The counter top may be fitted with heating and/or cooling equipment for dished foods to be supported thereon as shown in, e.g., Kinkaid Pat. No. 2,968,363 and Weddendorf Pat. No. 4,007,810. Further, the counter top 10 may be fitted with stepped shelves and/or sloped ice trays as shown in Weddendorf Pat. Nos. 3,847,250 and 4,007,810. Furthermore, the exterior periphery of the counter 9, for that section in the customer service area, may be provided with stalls for the customers if desired as shown in Weddendorf Pat. Nos. 3,841,440 and 3,872,801.

The counter top 10 includes an annular depending flange 12 around the external or outer periphery 13 thereof. The annular flange 12, in effect, closes the gap between the counter top 10 and the counter's framework 11. An annular support rail 14 is also fixed to the underside of the counter top adjacent the outer periphery 13 thereof, but slightly spaced inwardly from that outer periphery. The support rail is circular in planar configuration, is concentric with the center or rotational axis 15 of the counter top 10, is of a channel shape in cross section. The support rail 14 structurally reinforces the counter top adjacent its outer periphery, as well as functions as a rail upon which the counter top is supported on framework 11. A plurality of structural angle members 16 are fixed on the underside thereof to extend radially from the center or rotational axis 15 of the counter top 10, the members extending in a star-shape configuration from the counter top's center to the support rail 14.

Figure 2:
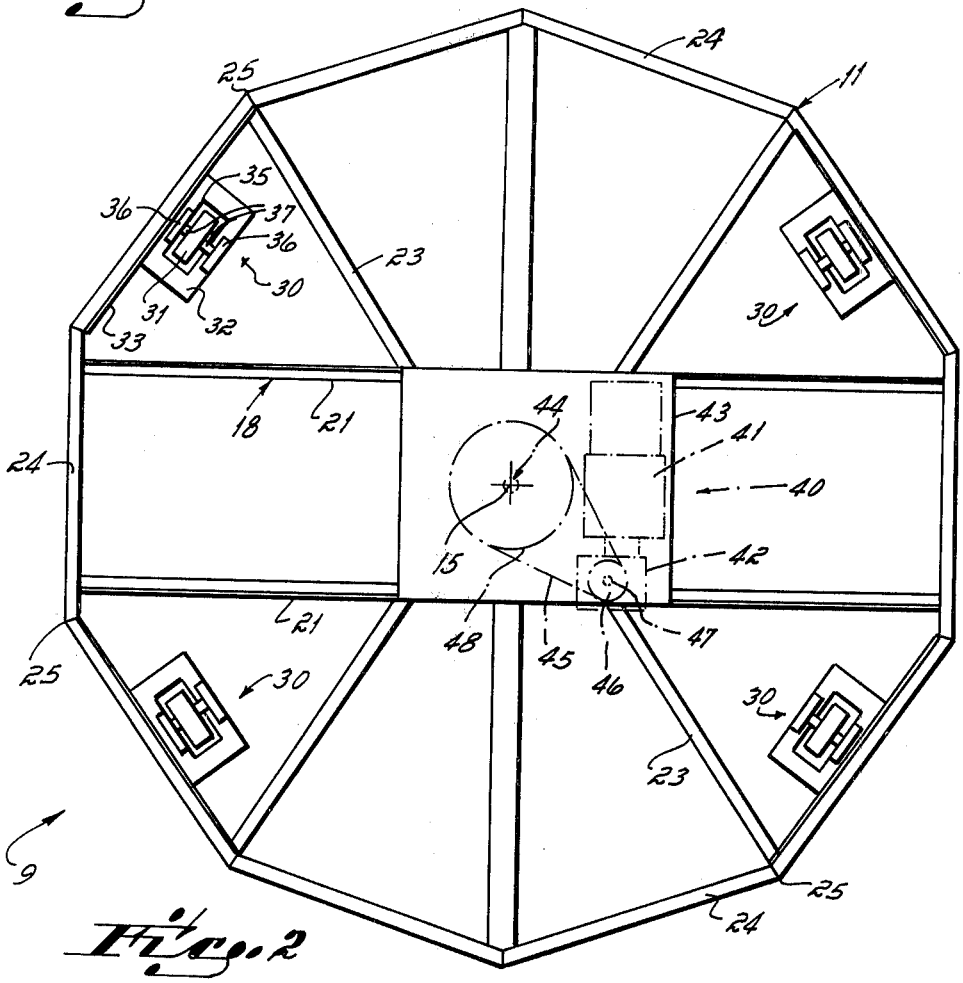
FIG. 2 is a top plan view of the framework for the food service counter.

The counter top 10, as previously mentioned, is adapted to rotate on the framework 11 which is immobile relative to ground 17. The framework 11 basically includes a floor frame 18 and a roof frame 19 connected by side wall posts 20, see FIGS. 1 and 2. The floor frame 18 is comprised of two structural brace members 21 extending across the floor frame 18 in spaced parallel fashion as shown in FIG. 2. The two main brace members 21 are connected with a plurality of peripheral structural angle members 22, the peripheral members being connected together one with another in generally circular configuration. Radial members 23 connect the peripheral members 22 with the two parallel spaced brace members 21 to complete the floor framework 18, thereby structurally rigidifying the floor framework. The roof frame 19 is comprised of peripheral members 24 connected together end to end in a manner like that of the floor framework's peripheral members 22. The roof frame 19 and floor frame 18 are connected together at corners 25 by corner posts 20. Thus, the floor frame 18, roof frame 19, and posts 20 cooperate to provide the stationary framework 11 for the counter top 10. A plurality of legs 26, connected thereto to the floor frame 18, are positioned at spaced relation about the periphery of the framework 11. The legs 26, of course, maintain the framework 11 in raised relation relative to ground 17 level so that customers may stand closed to the rotating counter top.

A series of four idler roller assemblies 30 are mounted on the counter top's framework 11 about the periphery thereof, see FIGS. 1 and 2. The idler roller 31 of each idler roller assembly is spaced inside the frame's outer periphery so that the counter top's annular rail 14 can ride thereon. Each idler roller assembly 30 includes a baseplate 32 disposed horizontally, the baseplate 32 being mounted to the framework 11 through idler mounting bracket 33 that extends between floor 22 and roof 24 peripheral members of the framework. The inner edge of the baseplate 32 is reinforced by brace member 34. The baseplate 32 includes a center hole 35 therein that permits the idler roller 31 to be mounted thereon in bearing blocks 36. Each idler roller 31 includes an axle 37 carried horizontally in the bearing blocks 36 at opposite ends thereof. The bearing blocks 36, of course, are fixed to the baseplate 32.

Figure 3:
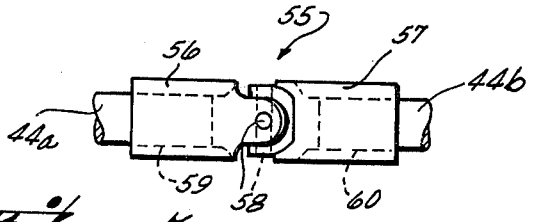
FIG. 3 is a cross-sectional view taken along line 3—3 of FIG. 2.

The improved drive system 40 is particularly illustrated in FIGS. 1 and 3. The improved drive system 40 includes a drive motor 41 and transmission 42 assembly carried on floor plate 43 that is fixed on the floor frame 18. The motor 41 and transmission 42 assembly is drivingly connected to primary drive shaft 44 by a flexible tension member in the form of chain 45. The chain 45 connects sprocket 46 fixed to secondary drive shaft 47 (which is integral with the transmission 42), and sprocket 48 fixed to the primary drive shaft 44. The primary drive shaft 44 itself includes upper **44*a* and lower 44*b* sections. The primary drive shaft's upper section 44*a* is coaxially fixed in place (relative to rotational axis 15) on the underside of and to the counter top 10, i.e., the upper section 44*a* is mounted immobily to the counter top and does not rotate relative thereto. The upper section 44*a* is maintained and reinforced in its fixed coaxial relation with the counter top 10 by brace members 44*c*. The primary drive shaft's lower section 44*b* is carried in bearing pillow block 49 and bearing flange unit 50. It is to the drive shaft's lower section 44*b* that sprocket 48 is fixed, the lower section thereby being connected with the drive motor 41 and transmission 42 assembly. The pillow block 49 is retained in fixed relation to the framework 11 by pillow block bracket 51 fixed to floor plate 43, and the flange unit 50 is mounted directly on the floor plate 43. The pillow block 49 and flange unit 50 do not provide any vertical support for the drive shaft 44; in effect, the drive shaft's lower section 44*b* simply floats in the bearings 49, 50 so provided. Thus, the drive shaft's lower section 44*b* is retained in coaxial alignment with the upper section 44*a*, is vertically disposed relative to the horizontal counter top 10, and is rotatable relative to framework 11**.

The upper section **44*a* and the lower section 44*b* of the drive shaft are connected by universal joint 55 more particularly illustrated in FIG. 3. The universal joint 55 permits the drive shaft's upper section 44*a* to tilt or angle slightly relative to the lower section 44*b* upon rotation of the lower section by the drive motor 41 and transmission 42 assembly. This, in turn, provides the horizontal counter top 10 itself with a very limited degree of tilting freedom that permits the counter top's support rail 14 to maintain supportive contact with all idler rollers 31 for minimizing vibration of the counter top during rotation by a single drive motor 41. In other words, and because of the unviersal joint 55, the counter top 10 may tilt or angle very slightly relative to the vertical if required due to any unevenness in the annular rail that rides on the idler rollers, or any wear that may occur in the bearings 49 or 50, thereby insuring that the counter top 10 rests on the idler rollers 31 fixed to the framework 11 throughout its continuous rotation. This minimizes vibration of the counter top 10** and, also, permits reinforcing of the counter top to be minimized since it is supported at its periphery and not at the center.

The universal joint 55 is particularly illustrated in FIG. 3. As shown in that figure, the universal joint includes an upper wrist 56 and a lower wrist 57, the wrists being pinned together by pins 58 in normal universal joint fashion. The primary drive shaft's upper section **44*a* is immobily fixed in bore 59 in the joint's upper wrist 56, and the primary drive shaft's lower section 44*b* is immobily fixed in bore 60 in the joints lower wrist 57. A working angle of about 25° between wrists 56 and 57 is desirable for the joint 55**.

Having described in detail the preferred embodiment of my invention, what I desire to claim and protect by Letters Patent is:

1. A cafeteria type food service counter comprising a generally circular counter top, an immobile support frame having a plurality of idler rollers mounted thereon, said idler rollers being adapted to cooperate with said counter top to support said counter top for rotation relative to said support frame, a primary drive shaft having an upper section and a lower section, said upper section being fixed to the underside of said counter top in coaxial fashion relative to the rotation axis of said counter top, drive means connected with said lower section of said primary drive shaft, and a universal joint connecting said upper section and said lower section of said primary drive shaft, said universal joint serving to transmit rotation from said primary drive shaft's lower section to said primary drive shaft's upper section for rotating said counter top, said universal joint also serving to permit limited tilting or flexing of said counter top relative to the horizontal, and said universal joint cooperating with said idler roller support of said counter top for minimizing significant vibration of the counter top during rotation thereof by allowing said counter top to flex or tilt slightly if required relative to its rotation axis to maintain supportive contact with said idler rollers.

2. A counter as set forth in claim 1 in which said primary drive shaft's lower section is substantially coaxially disposed with said primary drive shaft's upper section.

3. A counter as set forth in claim 1 including bearing means supporting said primary drive shaft's lower section for rotation, said bearing means being mounted on said framework.

* * * * *